United States Patent [19]

Butler et al.

[11] 4,158,804

[45] Jun. 19, 1979

[54] MOSFET REFERENCE VOLTAGE CIRCUIT

[75] Inventors: Walter J. Butler, Scotia; Charles W. Eichelberger, Schenectady, both of N.Y.

[73] Assignee: General Electric Company, Schenectady, N.Y.

[21] Appl. No.: 823,383

[22] Filed: Aug. 10, 1977

[51] Int. Cl.[2] ..... G05F 1/56

[52] U.S. Cl. ..... 323/22 R; 307/297; 307/304; 340/347 MZ

[58] Field of Search ..... 323/22 R, 16, 19; 340/347 MZ; 357/23, 41; 307/304, 296, 297

[56] References Cited

U.S. PATENT DOCUMENTS

| | | | |
|---|---|---|---|
| 3,508,084 | 4/1970 | Warner, Jr. | 357/41 |
| 3,743,923 | 7/1973 | Steudel | 323/22 R |
| 4,004,164 | 1/1977 | Cranford, Jr. et al. | 323/22 R |
| 4,096,430 | 6/1978 | Waldron | 323/22 R |

OTHER PUBLICATIONS

Amelco Semiconductor-*FETS Theory and Application Notes* No. 2, jun. 1962, pp. 1–7.

*Electronics* Jul. 21, 1969; "FET Buffer Boasts High Speed and Performance" by Atlas; pp. 82, 83.

*Electronics Letters* Sep. 16, 1976, vol. 12, No. 19 pp. 491–493 "Charge Transfer A/D Converter" Butler et al.

*Primary Examiner*—Gerald Goldberg

*Attorney, Agent, or Firm*—Geoffrey H. Krauss; Joseph T. Cohen; Marvin Snyder

[57] ABSTRACT

A stable temperature-insensitive constant reference voltage circuit is provided which can be implemented in either MOS or bipolar technology. The circuit may be implemented by MOSFET devices on a single chip with another circuit such as an A/D converter to provide a monolithic A/D converter with its own internal reference voltage circuit. The reference voltage circuit consists of a series-connected long channel MOSFET and short channel MOSFET which produce, at their junction, a temperature-independent voltage. A differential circuit containing three MOSFET devices is then provided with one of the devices serving as a current source which carries the current of the other two MOSFET devices which are in parallel. The gates of the two parallel MOSFET devices are connected respectively to the junction between the long channel and short channel device and to the output voltage. Current divides between the two parallel MOSFET devices in such a way as to cause a constant output voltage to be produced regardless of the variations of the supply voltage sources $V_{dd}$ or $V_{gg}$. The various MOSFET devices are formed on the same substrate containing the circuit components being connected to the constant stable voltage reference source.

12 Claims, 2 Drawing Figures

MOSFET REFERENCE VOLTAGE CIRCUIT

BACKGROUND OF THE INVENTION

This invention relates to constant voltage output circuits, and more specifically relates to a novel temperature-stable constant output voltage circuit which can be implemented with MOSFET transistors on the same monolithic chip containing other circuits which are to be connected to the constant reference voltage source.

The use of MOSFET devices to create complex circuits on a single semiconductor chip is well known. A typical circuit of this type is an analog-to-digital converter, or A/D converter, disclosed in *Electronics Letters* Sept. 16, 1976, Volume 12, No. 19, pages 491 to 493, entitled CHARGE-TRANSFER ANALOGUE-TO-DIGITAL CONVERTER, by W. J. Butler and C. W. Eichelberger. Most A/D converters of the type disclosed in the above article require a stable reference voltage in order to make accurate measurements and to provide an output reading in absolute units. The performance of the converter is directly determined by the stability of the reference voltage source and, as a result, the generation of a stable, termperature-insensitive reference voltage plays an important part in the proper functioning of the circuit.

At the present time, reference voltage generators normally employ bipolar devices and, therefore, cannot be processed or placed on the same monolithic chip with an A/D converter which is implemented by MOSFET devices. Therefore, it has been necessary, when an A/D converter or other similar type device is implemented by MOSFET techniques, to have a stable reference voltage supplied by some external circuit off the chip. This is also often true when the implementation of the A/D circuit is with bipolar devices since the processing required for a temperature-stable bipolar reference such as a zener diode, is not always compatible with the A/D circuit process requirements. Thus, at the present time there is no monolithic A/D converter which is complete in itself and all known devices require an external reference voltage chip or other circuit, the cost of which may be comparable to that of the cost of the A/D converter.

BRIEF SUMMARY OF THE PRESENT INVENTION

In accordance with the present invention, a novel temperature-stable constant reference voltage circuit is provided which can be implemented with MOSFET devices and, therefore, can be incorporated in the same chip with the circuit which requires the stable voltage reference source. Consequently, the need for an external reference voltage source circuit is eliminated, thus enabling a smaller overall package for the circuit with increased reliability and lower cost for a given circuit configuration.

While the novel circuit of the present invention is particularly desirable since it lends itself to MOSFET implementation, it should be noted that the circuit can be implemented by bipolar technology as well and the circuit can be used as a constant stable voltage reference supply implemented with either MOS or bipolar technology on its own chip, or can be implemented along with other MOS or bipolar devices on common chips.

In accordance with the invention, a first circuit consisting of a long channel MOS device and a "punch-through" short channel device are connected in series with the supply voltage. The supply voltage may vary due to temperature fluctuations, aging and the like. The voltage produced at the junction of these two devices, however, is a voltage which is stabilized against fluctuation due to temperature change. A second circuit is then provided which contains two parallel MOS devices which receive current from a third MOS device which serves as a current source. The temperature-stabilized reference voltage is connected to the gate of one of the two devices in the differential circuit, and the voltage connected to the gate of the other of the two parallel MOS devices is a voltage derived form the constant output voltage terminal of the circuit. The circuit then operates to force the output voltage to remain constant; this voltage being applied to the gate of the long-channel current source, thereby ensuring a constant and predetermined current-level for the short channel punch-through device. This ensures a temperature-stable reference voltage which is applied to one side of the differential pair.

The current through the differential pair then divides such that the voltage at the constant output voltage terminal remains at some preselected constant value even though the supply voltage changes.

While the novel circuit of the invention can be implemented in several ways, it has the particular advantage of being capable of being formed on the same substrate as the main circuit which is to be connected to the constant voltage reference, such as an A/D converter or the like.

DETAILED DESCRIPTION OF THE INVENTION

Figure 1:
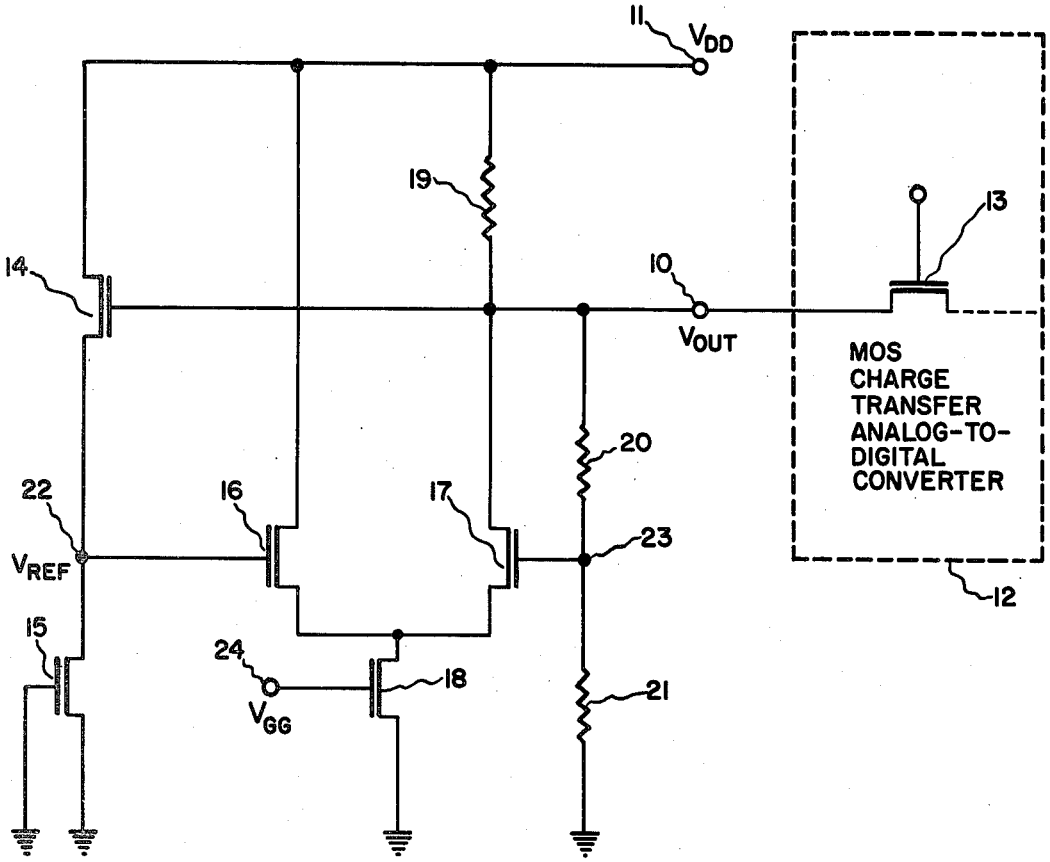
FIG. 1 is a circuit diagram showing the implementation of the novel circuit of the present invention with MOSFET devices which can be formed on the same substrate as a MOSFET type charge transfer analog-to-digital converter circuit.

Referring first to FIG. 1, the novel circuit is shown which provides a stable, temperature-insensitive constant voltage output $V_{OUT}$ at terminal 10. The voltage $V_{OUT}$ may be any arbitrary voltage magnitude, (depending on geometry, such as channel length of the devices) $\pm 0.1\%$ for a temperature variation of $\pm 50°$ C. and a 10% variation in supply voltage.

This stable voltage is provided from a voltage supply $V_{DD}$ connected to terminal 11, where the voltage $V_{DD}$ can have a potential nominally of about $-20$ volts relative to ground where, however, this voltage will vary with line voltage fluctuations, for example.

The voltage $V_{OUT}$ at terminal 10 may then be used in connection with a schematically illustrated MOS charge transfer analog-to-digital converter 12 which can be of the type shown in the article in *Electronics Letters*, entitled CHARGE-TRANSFER ANALOGUE-TO-DIGITAL CONVERTER, referred to hereinabove. As pointed out previously, device 12 may be implemented by MOS transistors on a common substrate with one of the transistors schematically illustrated as transistor 13, having one of its terminals connected to the voltage output terminal 10 for operation during the reference voltage input cycle of the charge transfer converter 12.

FIG. 1 illustrates the circuit implemented with MOSFET type devices which can be formed on the same substrate with the devices of converter 12. The transistors shown include five transistors 14, 15, 16, 17 and 18 connected as illustrated. The circuit also includes three resistors 19, 20 and 21 connected as shown where each of the resistors may have a value of 100K. Resistors 19, 20 and 21 can, if desired, be formed by MOS transistors which are operated in their linear regions and thus can be processed on the same chip with the remainder of the circuit of FIG. 1.

The junction between resistors 19 and 20 and the gate of transistor 14 are connected to the voltage output terminal 10. Node 22 at the junction between transistors 14 and 15 is connected to the gate of transistor 16 while the node 23 between resistors 20 and 21 is connected to the gate of transistor 17. The gate of transistor 15 is connected to ground and the gate of transistor 18 is connected to a terminal 24 which is connected to a voltage source $V_{GG}$ which may be about 6 volts but which need not be a stabilized voltage. The source terminals of transistors 15 and 18 are connected to ground as illustrated.

The transistors 14 and 15 are so constructed that they produce a reference voltage $V_{REF}$ at node 22 which is insensitive to temperature fluctuation. More specifically, transistor 15 is a short channel transistor which is operated in a "punch-through" mode. That is, the voltage $V_{DD}$ at terminal 11 is sufficiently high to cause the source and drain depletion regions of transistor 15 to meet, at which point the current through the device becomes space-charge limited. At an optimum current density (approximately 50 A/cm$^2$), the potential at point 22 due to the drop across transistor 15 becomes temperature-insensitive. Transistor 14 is a long-channel device and consequently acts as a current source in which the current through transistor 14 changes a relatively small amount for relatively large changes in the voltage $V_{DD}$. Consequently, in the circuit of FIG. 1, the potential at node 22 will vary only slightly with changes in voltage $V_{DD}$ at terminal 11 and the voltage at node 22 is temperature-insensitive and does not vary due to temperature changes applied to the entire circuit.

It should be understood that there are many ways in which the current source 14 could be implemented and the single transistor implementation shown in FIG. 1 is presented for illustrative purposes only.

A differential circuit consisting of transistors 16, 17 and 18 is then provided which, in essence, maintains the voltage at the gate of transistor 14 constant and independent of variations in $V_{DD}$. Thus, the current supplied by transistors 14 to 15 is maintained at its optimum level for temperature stability.

Resistors 19, 20 and 21 which cooperate with transistors 16, 17 and 18 define a feedback circuit for feeding back a fraction of the drain voltage of transistor 17 to its own gate at node 23 in such a way that for any change in supply voltage $V_{DD}$ or in circuit parameter values such as changes in device threshold voltages, the current division between transistors 16 and 17 will adjust to keep the drain voltage of transistor 17 constant. Thus, the gate-source voltage of transistor 14 is made insensitive to such changes and the current supplied to the punch-through device 15 is correspondingly stable. Consequently, the gate voltages of transistors 16 and 17 will always seek a level such that the potentials at nodes 22 and 23 will be stable and therefore the potential at the gate of transistor 14 and thus of the output voltage source terminal 10 will be some predetermined constant value.

It should be noted that in the example given for the present invention that the resistors 19, 20 and 21 have equal values so that the fraction of the drain voltage applied to the gate of transistor 17 is exactly one-half. Other values could have been selected.

In more detail, the operation of the differential circuit consisting of transistors 16, 17 and 18 is such that a constant current will flow through transistor 18 which acts as a current source. Consequently, a given total current will flow through the differential circuit parallel transistors 16 and 17 and this total current will divide between the two transistors in accordance with their respective gate voltages. In fact, the entire differential circuit acts as a high gain circuit which tends to maintain nodes 22 and 23 at the same potential. In equalizing these two potentials, however, current will divide between the transistors 16 and 17 in such a manner as to maintain the voltage of terminal 10 constant, thereby fixing the gate voltage for transistor 14.

The operation of the circuit of FIG. 1 is as follows, assuming, for example, that the voltage $V_{DD}$ at terminal 11, for some reason, becomes less negative in absolute value:

When the potential of terminal 11 becomes less negative, the potential of terminal 10 will also tend to become less negative than its preset voltage reference value. The voltage at node 23 will tend to become less negative, and the current through transistor 17 will decrease. The current through transistor 16 will then increase, since a constant current is supplied by transistor 18. As a result of the decrease in current through transistor 17, the voltage drop across resistor 19 decreases, and the potential at terminal 10 will tend to become more negative and back toward its preset reference value. Transistor 16 operates to allow a change in current to flow in that leg of the differential pair, so that the voltage drop across resistor 19 compensates for any decrease in $V_{DD}$.

In summary, if $V_{DD}$ decreases $V_{OUT}$ tends to decrease, but the voltage at node 23 also decreases. This causes the current in transistor 17 to decrease and the current in transistor 16 increases to decrease the drop on resistor 19 and increase $V_{OUT}$, such that $V_{OUT}$ remains constant.

Figure 2:
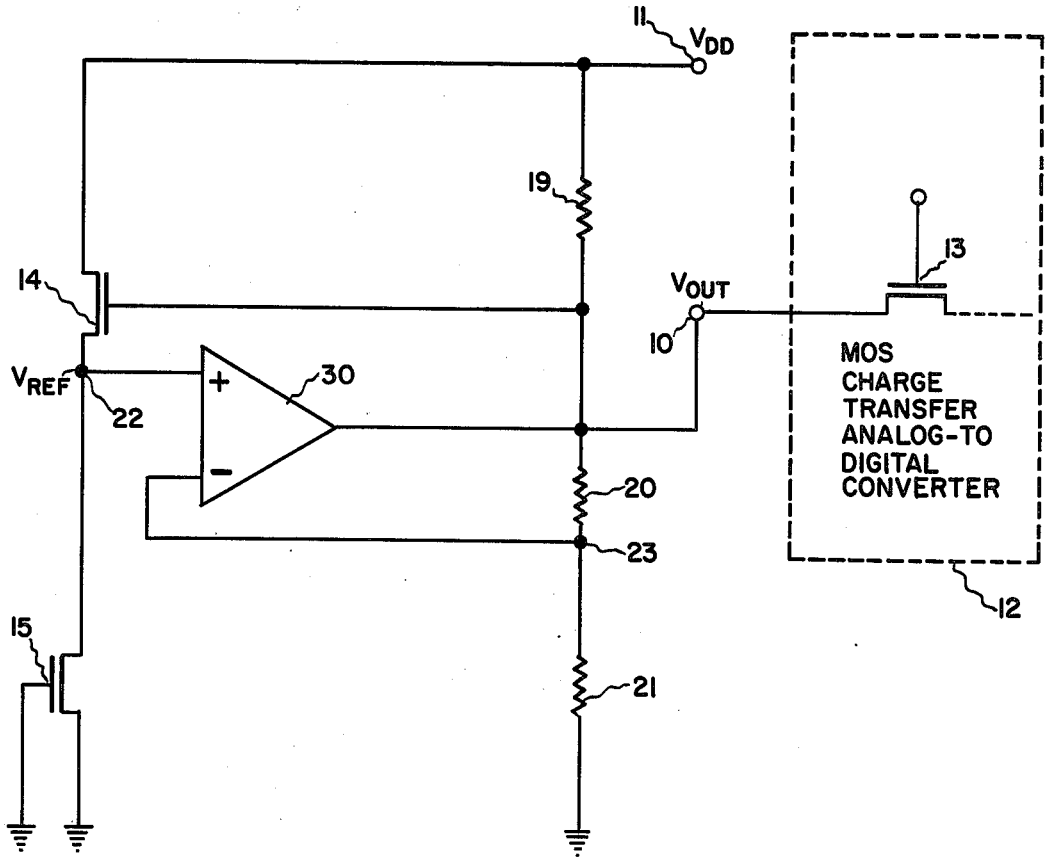
FIG. 2 is a schematic diagram of FIG. 1 for illustrating the operation of the circuit.

The operation of the circuit of FIG. 1 can also be understood by considering the circuit including transistors 16, 17 and 18 to be an amplifier as shown in FIG. 2. In FIG. 2, components which are identical to those of FIG. 1 have identical identifying numerals, and transistors 16, 17 and 18 are shown as amplifier 30. Amplifier 30 acts to maintain the voltages at its inputs (nodes 22 and 23) the same by driving more or less current through resistor 19, thus keeping voltage $V_{OUT}$ constant.

In the above, the novel circuit of FIG. 1 has been described when implemented by MOSFET devices. As pointed out previously, the circuit clearly could be implemented by bipolar devices and the circuit, whether implemented by MOS devices or by bipolar devices, could be formed on a single chip in the absence of any other circuitry.

Although a preferred embodiment of this invention has been described, many variations and modifications will now be apparent to those skilled in the art, and it is therefore preferred that the instant invention be limited not by the specific disclosures herein but only by the appended claims.

We claim:

1. A circuit for providing a stable reference output voltage at an output terminal, comprising, in combination: a supply voltage source; first circuit means connected to said supply voltage source and to said output terminal for producing a first voltage which does not vary due to changes in temperature; and differential circuit means connected to said first voltage for producing a second voltage at said output terminal which is constant despite fluctuations of supply voltage; said differential circuit means consisting of a single current source means and first and second parallel transistor means each connected in series with said current source means; said first voltage being connected to the gate of said first transistor means; resistive feedback circuit means connecting said second voltage to a gate electrode of said second transistor means; and resistor means in series only with said second transistor means and connected between said supply voltage source and said second voltage at said output terminal.

2. The circuit of claim 1 wherein said single current source means comprises a transistor.

3. The circuit of claim 1 wherein said first circuit means comprises third and fourth transistor means connected in series with one another and in series with said supply voltage source; said third transistor means having a gate electrode connected to said output terminal; said third and fourth transistor means comprising long channel and short channel devices, respectively.

4. The circuit of claim 3 wherein said current source means comprises a transistor.

5. The circuit of claim 4 wherein each of said transistor means are MOSFET devices and wherein said circuit is formed on a monolithic chip.

6. The circuit of claim 1 wherein each of said transistor means are MOSFET devices and wherein said circuit is formed on a monolithic chip.

7. In combination, a charge transfer analog-to-digital converter circuit, and the stable reference voltage circuit of claim 1, each of said converter circuit and reference voltage circuit being implemented by MOSFET devices fabricated on a single monolithic chip.

8. A temperature-insensitive semiconductor voltage reference device, comprising:

a short channel semiconductor device operated in a punch-through mode;

a long channel semiconductor device having a gate electrode and operated as a current source supplying current to said short channel semiconductor device; the magnitude of current supplied by said long channel semiconductor device varying as a function of the voltage at said gate electrode; and means for compensating for variations in the magnitude of a voltage source supplying power to said voltage reference device so as to apply a substantially constant voltage to said gate irrespective of variations in said power supply, whereby the current supplied by said long channel semiconductor device and the voltage across said short channel device remain substantially constant irrespective of variations in the temperature of said semiconductor devices and the magnitude of said voltage source.

9. The device of claim 8, wherein said variation compensating means is a differential amplifier having a non-inverting input connected to the junction between said short and long channel semiconductor devices, an output coupled to said gate electrode, and an inverting input receiving a portion of a signal at the output of said differential amplifier.

10. A stable reference output voltage circuit comprising, in combination: a supply voltage source; an output terminal at which the stable reference output voltage appears; first and second transistor means connected in series with one another and in series with said supply voltage source and producing a first voltage at the junction between said first and second transistor means which does not vary due to changes in temperature; said third and fourth transistor means comprising long channel and short channel devices, respectively; differential circuit means connected to said first voltage for producing a second voltage at said output terminal which is constant despite fluctuations of the supply voltage, the differential circuit means comprising a current source means and first and second parallel transistor means each connected in series with said current source means and with the first voltage being connected to a gate electrode of the first transistor means; a feedback circuit connecting a gate electrode of the second transistor means to the output terminal; and an electrical resistance in series with said second transistor means and connected between said supply voltage source and said second voltage.

11. The circuit of claim 10 wherein said current source means comprises a transistor.

12. The circuit of claim 11 wherein each of the transistor means are MOSFET devices and the circuit is formed on a monolithic chip.

* * * * *